US009226643B2

(12) United States Patent
Garnett et al.

(10) Patent No.: US 9,226,643 B2
(45) Date of Patent: Jan. 5, 2016

(54) SILVERWARE BASKET FOR A DISHWASHER APPLIANCE

(75) Inventors: William Nathan Garnett, Ekron, KY (US); Daniel J. Hart, Louisville, KY (US)

(73) Assignee: General Electric Company, Schenectady, NY (US)

( * ) Notice: Subject to any disclaimer, the term of this patent is extended or adjusted under 35 U.S.C. 154(b) by 898 days.

(21) Appl. No.: 13/443,013

(22) Filed: Apr. 10, 2012

(65) Prior Publication Data

US 2013/0264920 A1 Oct. 10, 2013

(51) Int. Cl.
*A47L 15/50* (2006.01)

(52) U.S. Cl.
CPC ..... *A47L 15/502* (2013.01)

(58) Field of Classification Search
CPC .... A47L 15/502; A47L 15/503; A47L 15/505
See application file for complete search history.

(56) References Cited

U.S. PATENT DOCUMENTS

| | | | | |
|---|---|---|---|---|
| 4,834,125 | A | 5/1989 | Insalaco | |
| 5,431,294 | A * | 7/1995 | Stottmann | A47L 15/502 211/181.1 |
| 2002/0139809 | A1 * | 10/2002 | Barry | A47L 15/502 220/762 |
| 2007/0039636 | A1 | 2/2007 | Egger et al. | |
| 2008/0302397 | A1 | 12/2008 | Buhlmeyer et al. | |

FOREIGN PATENT DOCUMENTS

| | | |
|---|---|---|
| EP | 0 143 754 | 6/1985 |
| EP | 1 281 347 | 2/2003 |

* cited by examiner

*Primary Examiner* — Jason Ko
*Assistant Examiner* — Spencer Bell
(74) *Attorney, Agent, or Firm* — Dority & Manning, P.A.

(57) ABSTRACT

A dishwasher appliance is provided with a silverware basket. The silverware basket is configured for mounting to a rack assembly of the dishwasher appliance. With the silverware basket mounted to the rack assembly, a handle of the silverware basket permits a user to selectively remove the rack assembly from a wash chamber of the dishwasher appliance or selectively dismount the silverware basket from the rack assembly.

10 Claims, 6 Drawing Sheets

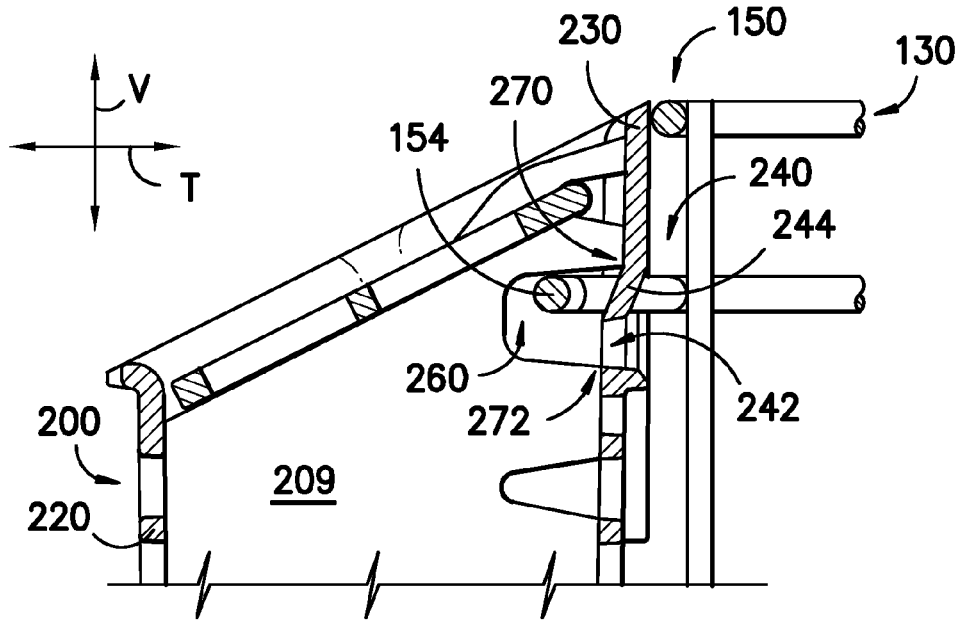
FIG. —7—
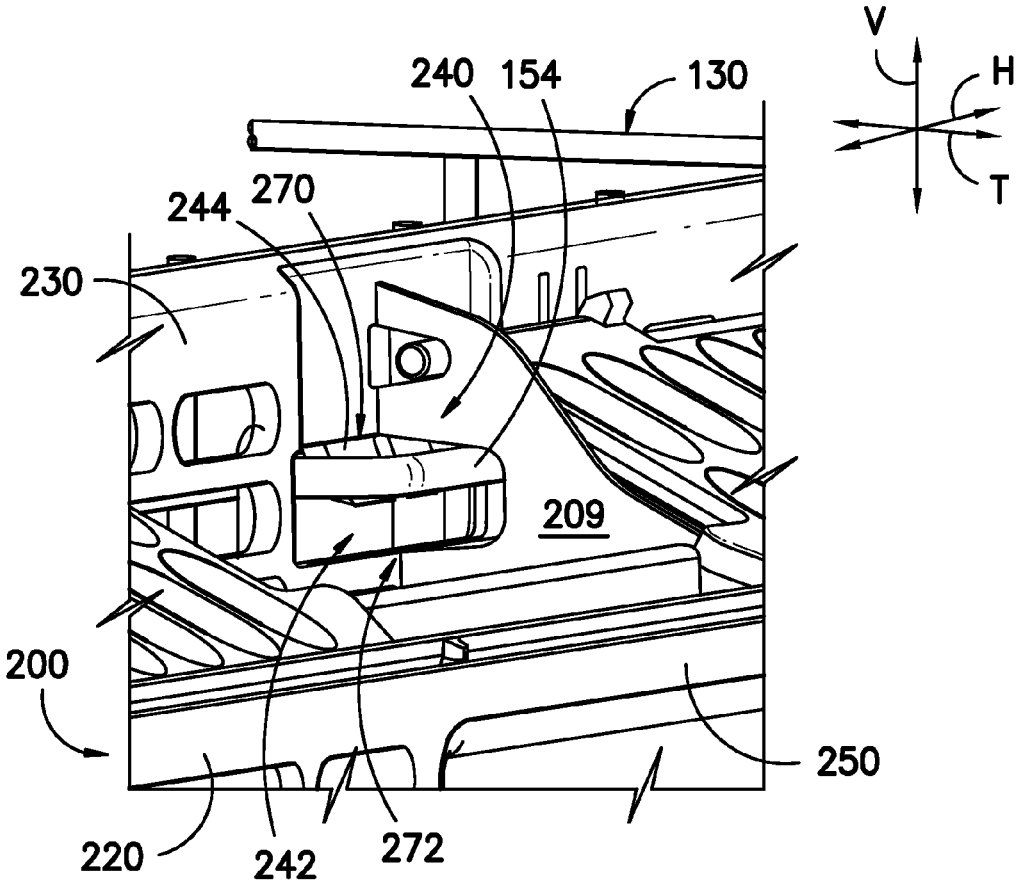
FIG. —8—

SILVERWARE BASKET FOR A DISHWASHER APPLIANCE

FIELD OF THE INVENTION

The present subject matter relates generally to silverware baskets for dishwasher appliances.

BACKGROUND OF THE INVENTION

Dishwasher appliances generally include a cabinet that defines a wash chamber. A rack assembly configured for receipt of articles (e.g., plates, cups, and/or bowls) for washing can be slidably received within the wash chamber. For example, the rack assembly can slide into and out of the wash chamber. A spray arm assembly configured for applying wash fluid to the articles in the rack assembly can also be mounted within the wash chamber.

Certain dishwasher appliances also include a silverware basket configured for receipt of articles (e.g., forks, knives, spoons, and/or other utensils) for washing. The silverware basket can be mounted within the wash chamber in various configurations. For example, the silverware basket can be mounted within the rack assembly, on a front of the rack assembly, and/or on a door of the appliance.

For dishwasher appliances where the silverware basket is mounted to the rack assembly, typically the rack assembly slides out of the wash chamber, e.g., when a user pulls on the rack assembly. However, when the silverware basket is mounted to a front of the rack assembly, it can be difficult for a user to determine a proper place to grab or grasp the rack assembly in order to pull it out of the wash chamber. In particular, the silverware basket can interfere with the user as he or she tries to pull on the rack assembly.

In such dishwasher appliances, the user can pull on the silverware basket in order to remove the rack assembly from the wash chamber. However, this can place an undesirable amount of stress on the mounting assembly that attaches the silverware basket to the rack assembly. Similarly, the portion of the silverware basket upon which the user pulls can be subjected to undesirable stresses. More particularly, because the silverware basket is not designed to be pulled upon to remove the rack assembly, such stress can break or in some other manner damage the mounting assembly or the silverware basket.

Accordingly, a silverware basket with features for assisting a user in moving a rack assembly in and out of the wash chamber of the dish washer would be useful.

BRIEF DESCRIPTION OF THE INVENTION

A dishwasher appliance is provided with a silverware basket. The silverware basket is configured for mounting to a rack assembly of the dishwasher appliance. With the silverware basket mounted to the rack assembly, a handle of the silverware basket permits a user to selectively remove the rack assembly from a wash chamber of the dishwasher appliance or selectively dismount the silverware basket from the rack assembly. Aspects and advantages of the invention will be set forth in part in the following description, or may be obvious from the description, or may be learned through practice of the invention.

In a first exemplary embodiment, a dishwasher appliance is provided. The dishwasher appliance includes a tub that defines a wash chamber. A rack assembly is mounted within the wash chamber and configured for receipt of articles for cleaning. A silverware basket is removably mounted to a front of the rack assembly. The silverware basket extends between a first side and a second side along a horizontal direction. The silverware basket further extends between a top and a bottom along a vertical direction. The silverware basket also extends between a front and a back along a transverse direction. The transverse direction is perpendicular to the horizontal and vertical directions. The silverware basket includes a bottom wall, a front wall that extends from the bottom wall along the vertical direction, and a back wall that extends from the bottom wall along the vertical direction. The back wall is spaced apart from the front wall along the transverse direction. The bottom wall, the back wall, and the front wall assist in defining a cavity for receipt of articles for cleaning. A divider is positioned within the cavity and extends between and connects the front wall and the back wall along the transverse direction. A mounting assembly is positioned on the back wall where the divider connects with the back wall. The mounting assembly is configured for selectively securing the silverware basket to the rack assembly. A handle is mounted adjacent the divider. The mounting assembly urges the rack assembly along the transverse direction when a user pulls on the handle in the transverse direction.

In a second exemplary embodiment, a silverware basket for a dishwasher appliance is provided. The dishwasher appliance includes a rack assembly received within a wash chamber of the dishwasher appliance. The silverware basket is configured for selective mounting to a front of the rack assembly. The silverware basket includes a bottom wall, a front wall extending from the bottom wall along a vertical direction, and a back wall extending from the bottom wall along the vertical direction and spaced apart from the front wall along a transverse direction. The bottom wall, the back wall, and the front wall assist in defining a cavity for receipt of articles for cleaning. A first divider and a second divider are positioned within the cavity and extend between and connect the front wall and the back wall along the transverse direction. The first and second dividers are spaced apart along a horizontal direction. A first mounting assembly and a second mounting assembly are configured for selectively securing the silverware basket to the rack assembly of the dishwasher appliance. The first mounting assembly is positioned on the back wall where the first divider connects with the back wall. The second mounting assembly is positioned on the back wall where the second divider connects with the back wall. A handle extends between a first end and a second end along the horizontal direction. The first end of the handle is mounted to the first divider. The second end of the handle is mounted to the second divider.

These and other features, aspects and advantages of the present invention will become better understood with reference to the following description and appended claims. The accompanying drawings, which are incorporated in and constitute a part of this specification, illustrate exemplary embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 7 illustrates a partial, side cross-sectional view of the silverware basket and upper rack assembly of FIG. 4 taken along the 7-7 axis and, in particular, shows the mounting assembly securing the silverware basket to the upper rack assembly.

FIG. 8 illustrates a partial, perspective view of the silverware basket and upper rack assembly of FIG. 4 and, in particular shows an exemplary handle of the silverware basket.

DETAILED DESCRIPTION

Figure 1:
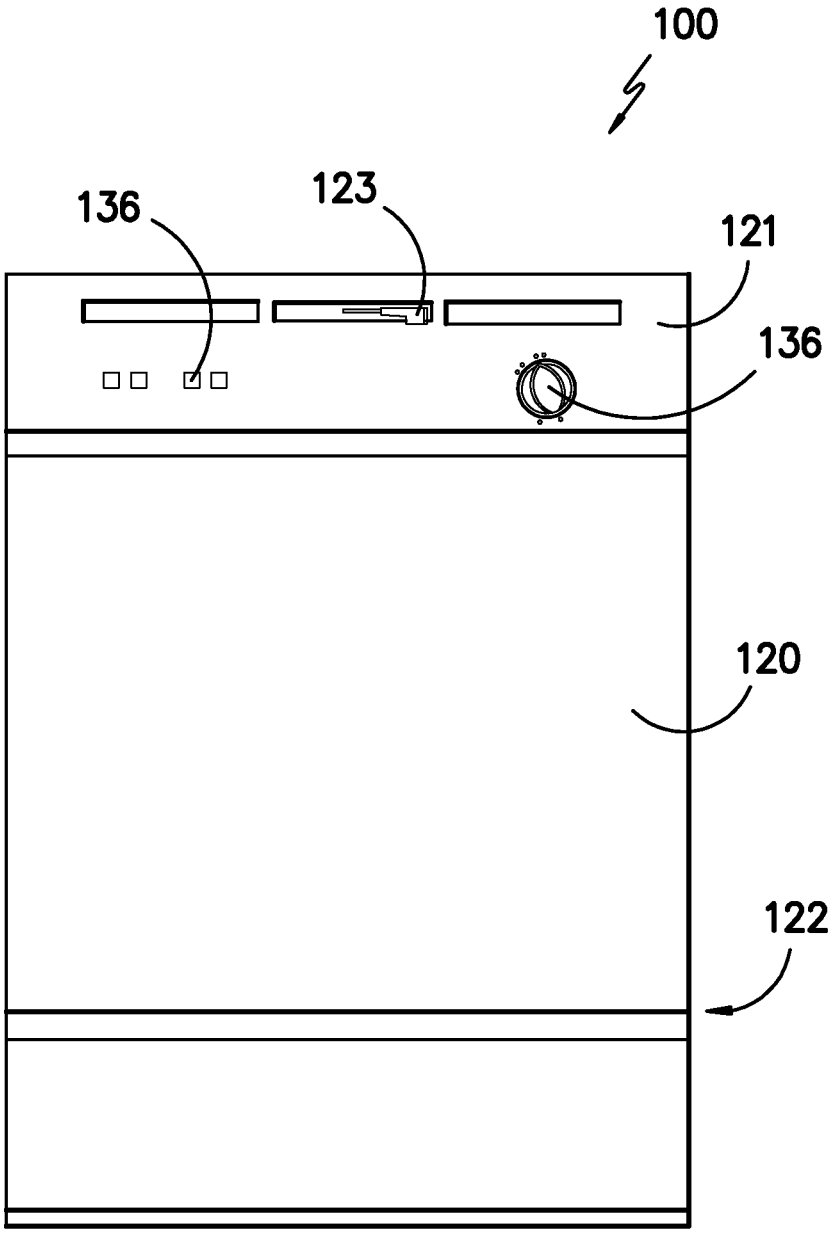
FIG. 1 provides a front view of a dishwasher appliance according to an exemplary embodiment of the present subject matter.

Reference now will be made in detail to exemplary embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
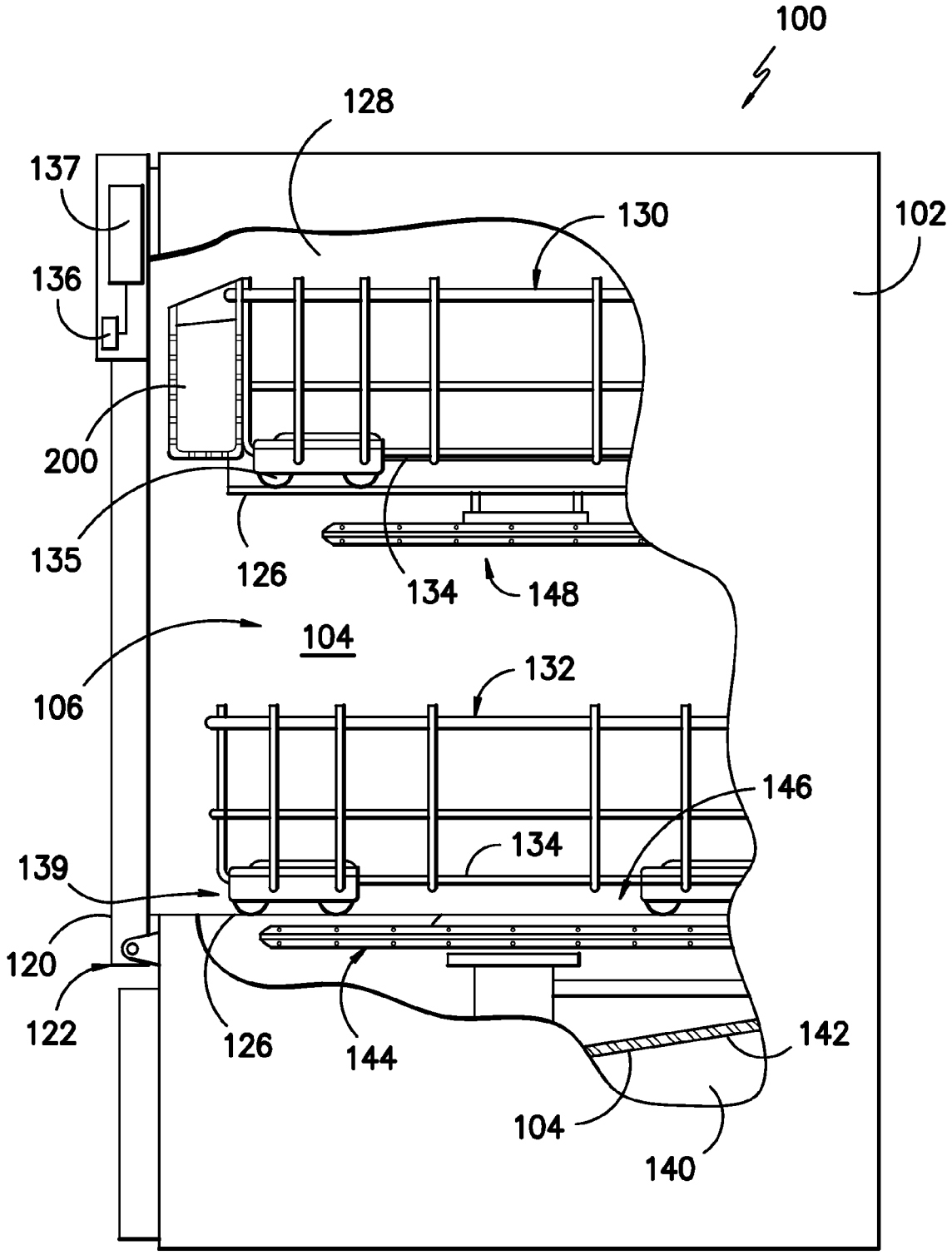
FIG. 2 illustrates a side view of the dishwasher appliance of FIG. 2 with portions of a cabinet of the dishwasher appliance removed to illustrate a wash chamber of the cabinet and, in particular, illustrates an exemplary embodiment of a silverware basket mounted to an upper rack assembly of the dishwasher appliance.

FIGS. 1 and 2 depict an exemplary domestic dishwasher 100 that may be configured in accordance with aspects of the present disclosure. The dishwasher 100 includes a cabinet 102 having a tub 104 therein that defines a wash chamber 106. The tub 104 includes a door 120 hinged at its bottom 122 for movement between a normally closed configuration (shown in FIGS. 1 and 2), wherein the wash chamber 106 is sealed shut (e.g., for washing operation), and an open configuration (e.g., for loading and unloading of articles from the dishwasher 100). A latch 123 is used to lock and unlock the door 120 for access to the chamber 106.

Guide rails 126 are mounted on tub side walls 128 and accommodate upper and lower roller-equipped rack assemblies 130, 132. Each of the upper and lower racks 130, 132 is fabricated from lattice structures that include a plurality of elongated members 134. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106.

A silverware basket 200 is removably mounted to upper rack assembly 130. However, silverware basket 200 may also be selectively attached to other portions of dishwasher 100, e.g., lower rack assembly 132. Silverware basket 200 is configured for receipt of silverware, utensils, and the like, that are too small to be accommodated by the upper and lower rack assemblies 130, 132. Silverware basket 200 may be constructed of any suitable material, e.g., metal or plastic, and is discussed in greater detail below.

The dishwasher 100 further includes a lower spray-arm assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack assembly 130. Additionally, an upper spray arm assembly (not shown) may be located above the upper rack assembly 130.

The lower and mid-level spray-arm assemblies 144, 148 and the upper spray arm assembly are fed by a fluid circulation assembly (not shown) for circulating water and dishwasher fluid in the tub 104. Portions of the fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower rack assemblies 130, 132, respectively and silverware basket 200. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 137 may be positioned in a variety of locations throughout dishwasher 100. In the illustrated exemplary embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one exemplary embodiment, the user interface 136 may represent a general purpose I/O ("GPIO") device or functional block. In one exemplary embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher and that the exemplary embodiment depicted in FIGS. 1 and 2 is for illustrative purposes only. For example, the present subject matter may be used in dishwasher appliances having other rack configurations.

Figure 3:
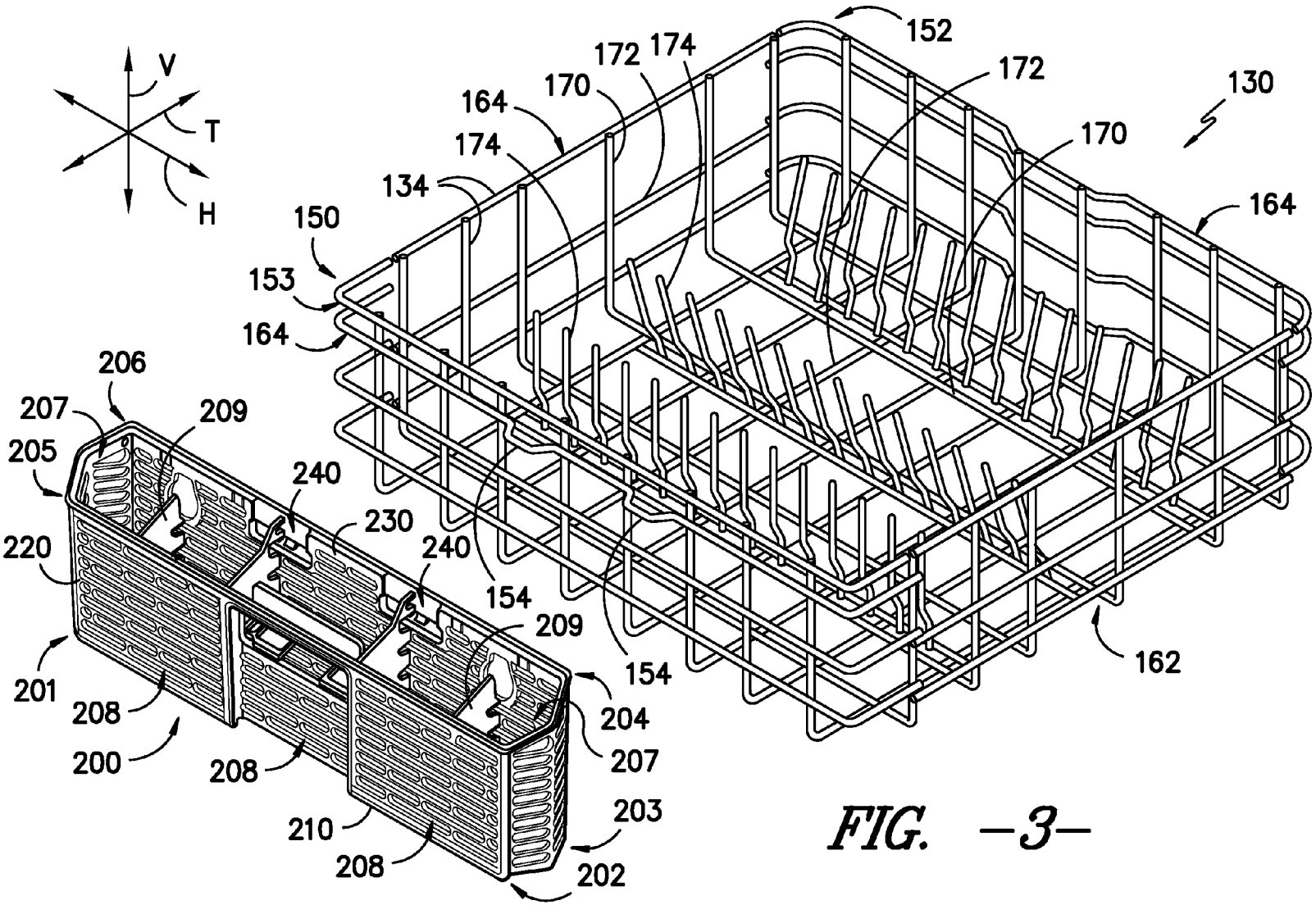
FIG. 3 illustrates a perspective view of the silverware basket and the upper rack assembly removed from the wash chamber of the dishwasher appliance of FIG. 2 with the silverware basket detached from the upper rack assembly.

FIG. 3 illustrates perspective view of upper rack assembly 130 and silverware basket 200 removed from dishwasher appliance 100. In FIG. 3, silverware basket 200 is detached and spaced apart from upper rack assembly 130. Upper rack assembly 130 is generally configured as a basket-like structure having a bottom wall 162 and surrounding sidewalls 164. As discussed above, upper rack assembly 130 is formed from plurality of elongated members 134. Thus, bottom wall 162 and sidewalls 164 may be formed with wire or rod members into an open lattice structure. For example, the bottom wall 160 may be defined by a plurality of longitudinal rods 170 that are crossed with a plurality of lateral rods 172, as generally known in the art. Rods 170, 172 may be connected together by any suitable means, including welding, epoxy, clips, and so forth. A plurality of fixed tines 174 project vertically upward from bottom wall 160 from any combination of the rods 170, 172. The fixed tines 174 are arranged in pairs along the longitudinal aspect of the bottom wall 160 with a defined space of "pitch" between adjacent pairs of the tines 174.

Silverware basket 200 extends between a first side 201 and a second side 202 along a horizontal direction H. Silverware basket 200 further extends between a top 203 and a bottom 204 along a vertical direction V. Silverware basket 200 also extends between a front 205 and a back 206 along a transverse direction T. Transverse direction T is substantially perpendicular to horizontal and vertical directions H, V. Thus, vertical direction V, horizontal direction H, and transverse direction T are orthogonally oriented such that vertical direction V, horizontal direction H, and transverse direction T form an orthogonal directional system.

Silverware basket 200 includes a bottom wall 210. A front wall 220 extends from bottom wall 210 along the vertical direction V. Similarly, a back wall 230 extends from bottom wall 210 along the vertical direction V. Back wall 230 and front wall 220 are spaced apart along the transverse direction T. Dividers 209 extend between front wall 220 and back wall 230 along the transverse direction T. Bottom wall 210, front wall 220, back wall 230, and dividers 209 assist in defining a plurality of cavities 207 configured for receipt of articles (e.g., forks, knives, spoons, and/or other utensils).

Bottom wall 210, front wall 220, and back wall 230 also define a plurality of holes 208. Plurality of holes 208 permit wash fluid to flow into and out of cavity 207, e.g., during operation of dishwasher appliance 100. Plurality of holes 208 also permit a flow of air through cavity 207, e.g., to assist in drying articles therein.

Upper rack assembly 130 extends between a front 150 and a back 152 along the transverse direction T. Elongated members 134 of upper rack assembly 130 adjacent front 150 of upper rack assembly 130 form projections 154. Projections 154 are positioned adjacent front 150 of upper rack assembly 130 and extend away from front 150 of upper rack assembly 130 along the transverse direction T. Projections 154 are configured for cooperating with mounting assemblies 240 (as will be further described) of silverware basket 200 in order to selectively secure silverware basket 200 to upper rack assembly 200.

Figure 4:
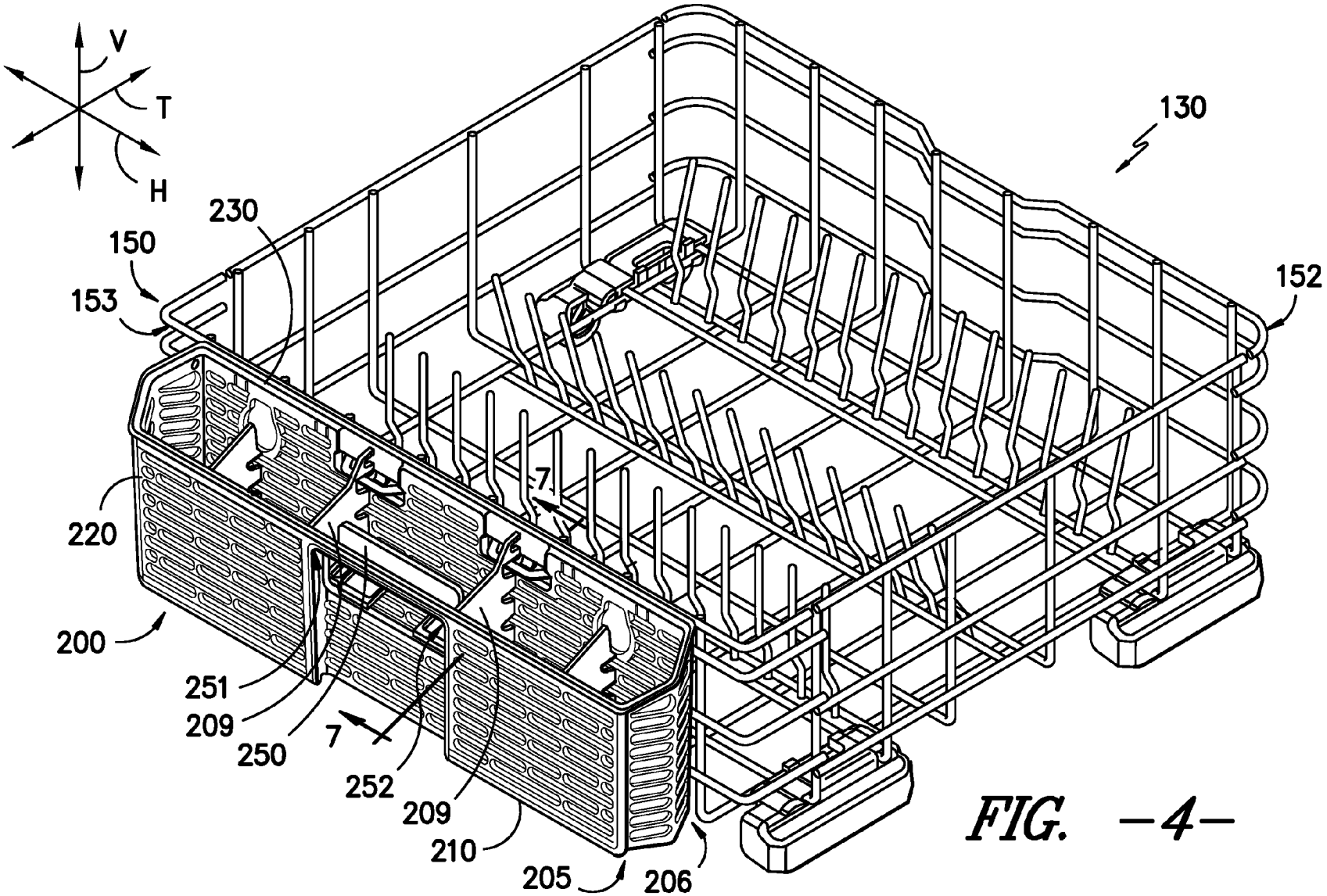
FIG. 4 provides a perspective view of the silverware basket and upper rack assembly of FIG. 3 with the silverware basket mounted to the upper rack assembly with an exemplary mounting assembly.
Figure 5:
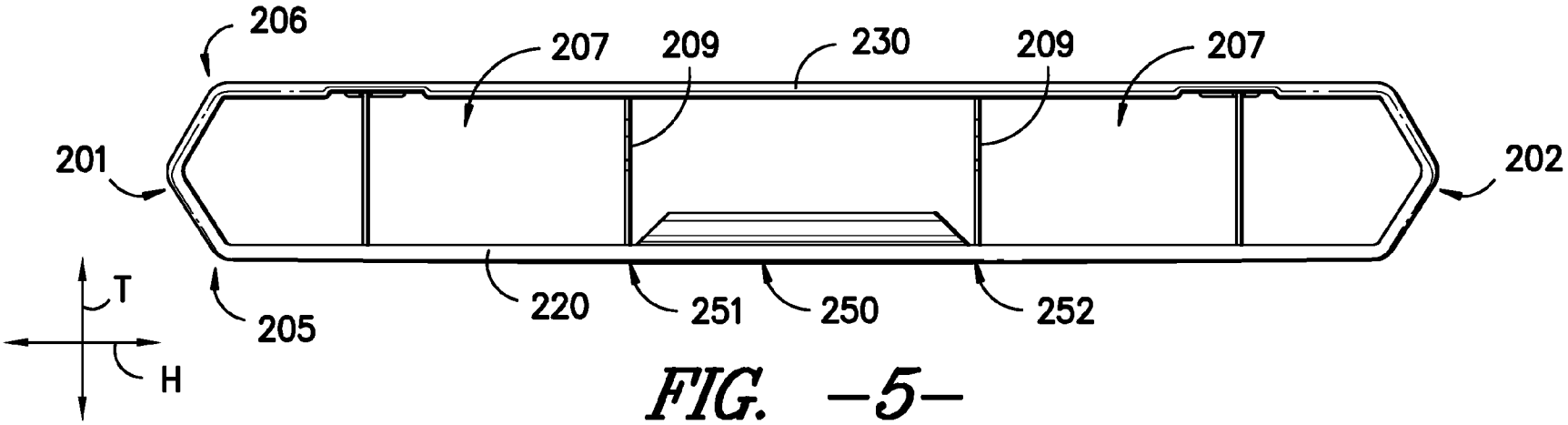
FIG. 5 illustrates a top view of the silverware basket of FIG. 3 with a bottom wall of the silverware basket removed for clarity.
Figure 6:
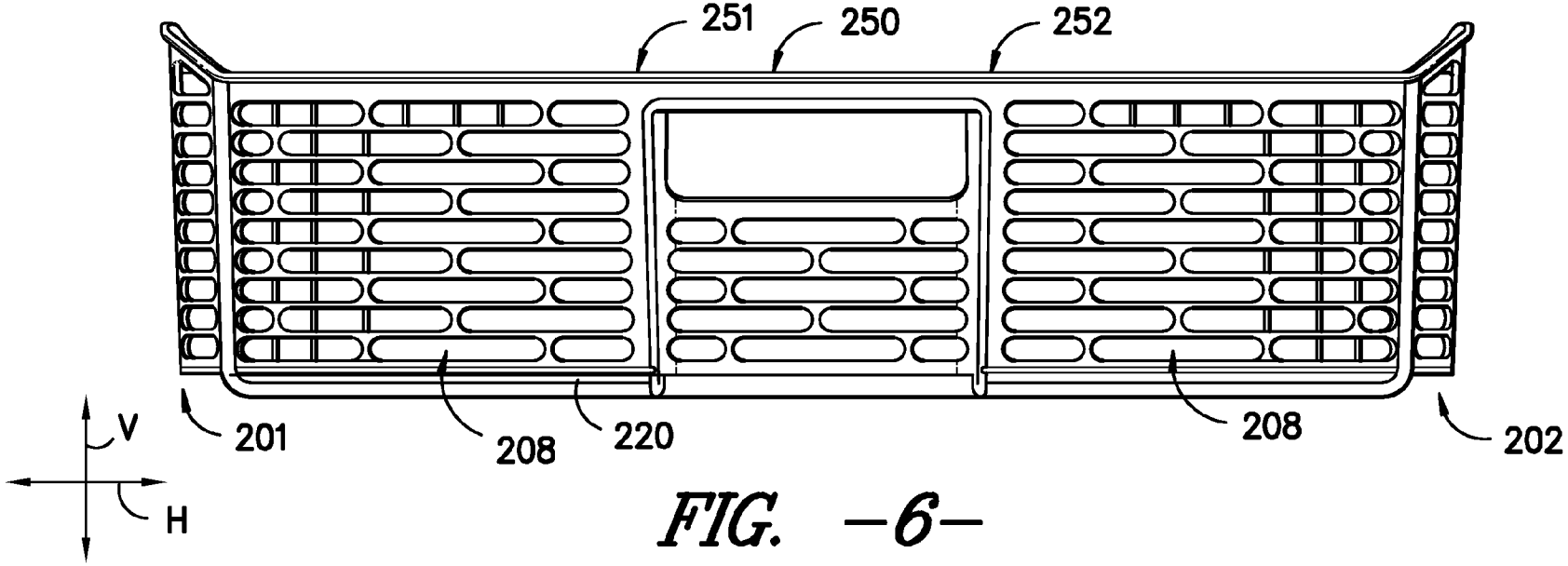
FIG. 6 provides a front view of the silverware basket of FIG. 3 with a back wall of the silverware basket removed for clarity.

FIG. 4 illustrates a perspective view of silverware basket 200 mounted to front 150 of upper rack assembly 130 with projections 154 (FIG. 3) and mounting assemblies 240 (FIG. 3) as discussed in greater detail below. FIG. 5 illustrates a top view of silverware basket 200 with bottom wall 210 (FIG. 4) removed for clarity. FIG. 6 illustrates a front view of silverware basket 200 with back wall 230 (FIG. 4) removed for clarity.

As may be seen in FIGS. 4-6, a handle 250 is mounted to silverware basket 200. Handle 250 extends longitudinally along the horizontal direction H between a first end 251 and a second end 252. Handle 250 extends between dividers 209 such that first end 251 of handle 250 is positioned adjacent one of dividers 209, and second end 252 of handle 250 is positioned adjacent another of dividers 209.

To assist a user in grasping handle 250, handle 250 is positioned adjacent front 205 of silverware basket 200. By positioning handle 250 adjacent front 205 of silverware basket 200, a user can easily grasp handle 250 due to the distance between handle 250 and back wall 230. If handle 250 were positioned adjacent back 206 of silverware basket 200, back wall 230 might interfere with a grip of the user. However, handle 250 could be placed adjacent back wall 230 in alternative exemplary embodiments. For example, if handle 250 formed a loop and extended above back wall 230 along the vertical direction V, handle 250 may be positioned adjacent back wall 230 such that back wall 230 would not interfere with the grip of the user. Other suitable locations and configurations for handle 250 may be utilized as well.

A user can lift on handle 250 to remove silverware basket 200 from upper rack assembly 130. For example, with silverware basket 200 mounted to upper rack assembly 130 as shown in FIG. 4, a user can lift on handle 250 and urge silverware basket 200 upwardly along the vertical direction V. When silverware basket 200 is lifted in the vertical direction V, silverware basket 200 may be dismounted from upper rack assembly 130, e.g., by moving silverware basket 200 away from upper rack assembly 130 along the transverse direction T. Alternatively, rather than removing silverware basket 200, with silverware basket 200 mounted to upper rack assembly 130 as shown in FIG. 4, the user can pull on handle 250 in the transverse direction T in order to urge upper rack assembly 130 in the transverse direction T as discussed in greater detail below.

The components of silverware basket 200 are designed to transfer force applied by a user on handle 250 to projection 154, e.g., in order to move upper rack assembly 130 out of wash chamber 106 (FIG. 2). However, as discussed above, silverware basket 200 may be constructed of plastic, and the force applied by the user to shift upper rack assembly 130 can generate unacceptable stress within components of silverware basket 200 and generate unwanted deformations within silverware basket 200 as well. Accordingly, the components of silverware basket 200 are designed to avoid potential damage to components of silverware basket 200 when a user pulls on handle 250 to move rack assembly 130. Thus, the construction of silverware basket 200 is designed to permit a user to pull on handle 250 of silverware basket 200 in order remove upper rack assembly 130 from wash chamber 106 without causing damage to or substantial permanent deformation of silverware basket 200.

FIG. 7 illustrates a partial, cross-sectional view of silverware basket 200 mounted to upper rack assembly 130 taken along the 7-7 axis shown in FIG. 4. FIG. 8 illustrates a partial, perspective view of silverware basket 200 mounted to upper rack assembly 130. As may be seen in FIGS. 7 and 8, back wall 230 of silverware basket 200 includes mounting assembly 240. Mounting assembly 240 includes an opening 242 defined by back wall 230. Opening 242 is configured for receipt of projection 154 of upper rack assembly 130. A hook 244 extends from back wall 230 into opening 242 and is configured for selectively securing silverware basket 200 to upper rack assembly 130. Other suitable mechanisms may be used to secure silverware basket 200 to upper rack assembly 130, e.g., hangers.

To mount silverware basket 200 to upper rack assembly 130, projection 154 is positioned within opening 242 such that hook 244 is disposed between projection 154 and front 150 of upper rack assembly 130. With hook 244 disposed between projection 154 and front 150 of upper rack assembly 130, silverware basket 200 hangs from front 150 of upper rack assembly 130 as shown in FIG. 4.

Hook 244 of mounting assembly 240 extends away from back wall 230 of silverware basket 200 along the transverse and vertical directions T and V. Hook 244 is angled, e.g., between about fifteen and about thirty-five degrees or between about twenty and about thirty degrees, such that projection 154 is urged against back wall 230 when a user pulls on silverware basket 200 in the transverse direction T. As may be seen in FIG. 7, when the user urges silverware basket 200 in the transverse direction T, e.g., using handle 250 (FIG. 8), projection 154 impacts hook 244 and slides up hook along the vertical direction V until projection 154 impacts back wall 230. Thus, hook 244 is configured for assisting handle 250 in permitting a user to shift upper rack assembly 130 in the transverse direction T.

Alternatively, as discussed above, a user can lift on handle 250 in the vertical direction V to remove silverware basket 200 from upper rack assembly 130. When silverware basket 200 is lifted in the vertical direction V, hook 244 disengages from projection 154 such that projection 154 is disposed below hook 244 along the vertical direction V. In such a configuration, silverware basket 200 may be dismounted from upper rack assembly 130, e.g., by moving silverware basket 200 away from upper rack assembly 130 along the transverse direction T.

Opening 242 is positioned on back wall 230 where divider 209 connects to back wall 230. Thus, a slot 260 (FIG. 7) defined by divider 209 receives projection 154 when silverware basket 200 is mounted to upper rack assembly 130. Slot 260 permits portions of divider 209 to be disposed adjacent both a top 270 and a bottom 272 of opening 242 such that divider 209 extends between top 270 and bottom 272 of opening 242. Thus, when a user pulls on handle 250 (FIG. 8) in the transverse direction T, the force applied by the user is transferred to back wall 230 at both top 270 and bottom 272 of opening 242 thereby avoiding a concentration of the force adjacent either the top 270 or the bottom 272 of opening 242. Similarly, because divider 209 can distribute such force substantially uniformly about opening 242 along the horizontal direction H. By distributing the force about opening 242 as described above, potential damage to silverware basket 200 can be avoided.

In FIGS. 7 and 8, silverware basket 200 includes a lid 280 rotatably mounted to divider 209. Lid 280 may selectively cover cavity 207. However, as shown in FIGS. 3 and 4, silverware basket 200 need not include lid 280.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a tub that defines a wash chamber;

a rack assembly mounted within the wash chamber and configured for receipt of articles for cleaning;

a silverware basket removably mounted to a front of said rack assembly, said silverware basket extending between a first side and a second side along a horizontal direction, said silverware basket further extending between a top and a bottom along a vertical direction, said silverware basket also extending between a front and a back along a transverse direction, the transverse direction being perpendicular to the horizontal and vertical directions, wherein said silverware basket comprises:

a bottom wall;

a front wall extending from said bottom wall along the vertical direction;

a back wall extending from said bottom wall, along the vertical direction and spaced apart from said front wall along the transverse direction, wherein said bottom wall, said back wall, and said front wall assist in defining a cavity for receipt of articles for cleaning;

a divider positioned within the cavity and extending between and connecting said front wall and said back wall along the transverse direction;

a mounting assembly positioned on said back wall where said divider connects with said back wall, said mounting assembly configured for selectively securing said silverware basket to said rack assembly;

a handle mounted adjacent said divider, wherein said mounting assembly urges said rack assembly along the transverse direction when a user pulls on said handle in the transverse direction; and wherein said mounting assembly comprises a hook extending into an opening defined by said back wall, the hook being configured for receipt of a projection that extends away from said rack assembly along the transverse direction.

2. The dishwasher appliance of claim 1, wherein said handle is positioned adjacent said front wall.

3. The dishwasher appliance of claim 1, wherein said divider comprises a first divider and a second divider positioned within the cavity and spaced apart along the horizontal direction, wherein said first and second dividers extend between and connect said front wall and said back wall along the transverse direction in order to divide the cavity into a plurality of cavities, wherein said handle extends between said first and second dividers along the horizontal direction.

4. The dishwasher appliance of claim 3, wherein said handle extends between a first end and a second end along the horizontal direction, the first end of said handle mounted to said first divider, the second end of said handle mounted to said second divider.

5. The dishwasher appliance of claim 3, wherein said handle is positioned adjacent the front of said silverware basket.

6. The dishwasher appliance of claim 1, Wherein the opening of said mounting assembly is positioned on said back wall where said divider connects with said back wall.

7. The dishwasher appliance of claim 6, wherein said divider extends between a top and a bottom of the opening of said mounting assembly.

8. The dishwasher appliance of claim 1, wherein the hook extends away from said back wall along the transverse and vertical directions towards said front wall.

9. The dishwasher appliance of claim 1, wherein said silverware basket defines a plurality of holes for permitting a flow of fluid out of the cavity of said silverware basket.

10. The dishwasher appliance of claim 1, wherein said silverware basket is constructed of plastic.

* * * * *